US011124907B2

(12) United States Patent
Nakano et al.

(10) Patent No.: US 11,124,907 B2
(45) Date of Patent: Sep. 21, 2021

(54) SPUN-BONDED NONWOVEN FABRIC

(71) Applicant: Toray Industries, Inc., Tokyo (JP)

(72) Inventors: Yohei Nakano, Shiga (JP); Yuka Nishiguchi, Shizuoka (JP); Takuji Kobayashi, Shiga (JP)

(73) Assignee: TORAY INDUSTRIES INC., Tokyo (JP)

( * ) Notice: Subject to any disclaimer, the term of this patent is extended or adjusted under 35 U.S.C. 154(b) by 0 days.

(21) Appl. No.: 16/480,964

(22) PCT Filed: Jan. 25, 2018

(86) PCT No.: PCT/JP2018/002238
§ 371 (c)(1),
(2) Date: Jul. 25, 2019

(87) PCT Pub. No.: WO2018/139523
PCT Pub. Date: Aug. 2, 2018

(65) Prior Publication Data

US 2020/0002862 A1 Jan. 2, 2020

(30) Foreign Application Priority Data

Jan. 27, 2017 (JP) ..... JP2017-012871

(51) Int. Cl.
*D04H 3/16* (2006.01)
*D04H 3/007* (2012.01)

(52) U.S. Cl.
CPC ..... *D04H 3/16* (2013.01); *D04H 3/007* (2013.01)

(58) Field of Classification Search
CPC ..... D04H 3/16; D04H 3/007; D04H 3/016
See application file for complete search history.

(56) References Cited

U.S. PATENT DOCUMENTS

| | | | | |
|---|---|---|---|---|
| 6,476,135 | B1 | 11/2002 | Bugada et al. | |
| 8,067,320 | B2 | 11/2011 | Hisamoto | |
| 2003/0083437 | A1 | 5/2003 | Bugada et al. | |
| 2005/0164587 | A1 | 7/2005 | Melik et al. | |
| 2005/0170727 | A1* | 8/2005 | Melik | D04H 3/007 442/327 |
| 2005/0244619 | A1 | 11/2005 | Kauschke et al. | |
| 2006/0008643 | A1* | 1/2006 | Lin | D04H 1/4382 428/364 |
| 2008/0172840 | A1* | 7/2008 | Kacker | D04H 3/16 19/66 R |
| 2009/0017710 | A1 | 1/2009 | Bugada et al. | |
| 2009/0022956 | A1 | 1/2009 | Hisamoto | |
| 2013/0099408 | A1 | 4/2013 | Melik et al. | |

FOREIGN PATENT DOCUMENTS

| | | | | |
|---|---|---|---|---|
| CN | 1383442 | A | 12/2002 | |
| CN | 1997786 | A | 7/2007 | |
| CN | 101415737 | A | 4/2009 | |
| CN | 101611181 | A | 12/2009 | |
| EP | 0933460 | A1 * | 8/1999 | D04H 3/16 |
| EP | 0933460 | A1 | 8/1999 | |
| EP | 1126065 | A2 | 8/2001 | |
| JP | 2007524008 | A | 8/2007 | |
| JP | 2009249764 | A | 10/2009 | |
| JP | 2010516836 | A | 5/2010 | |
| JP | 4943349 | B2 | 5/2012 | |
| JP | 2013159884 | A | 8/2013 | |
| JP | 2016183430 | A | 10/2016 | |
| KR | 20090103947 | A | 10/2009 | |
| TW | 393538 | B | 6/2000 | |
| TW | 201323676 | A | 3/2013 | |
| WO | 2005102682 | A2 | 11/2005 | |
| WO | 2007091444 | A1 | 8/2007 | |
| WO | 2008091432 | A2 | 7/2008 | |

OTHER PUBLICATIONS

Taiwan Office Action for Taiwan Application No. 107102830, dated May 26, 2020 with translation, 10 pages.
International Search Report and Written Opinion for International Application No. PCT/JP2018/002238, dated Mar. 13, 2018—5 pages.
Extended European Search Report for European Application No. 18 744 167.0, dated Feb. 19, 2020, 6 pages.
Korean Notice of Preliminary Rejection for Korean Application No. 2019-7021884, dated Jan. 5, 2021, with translation, 7 pages.
Indonesian Office Action for Indonesian Application No. P00201906473, dated Sep. 18, 2020 with translation, 6 pages.
Chinese Office Action for Chinese Application No. 201880008318.0, dated May 8, 2021 with translation, 13 pages.

* cited by examiner

*Primary Examiner* — Jeremy R Pierce
(74) *Attorney, Agent, or Firm* — RatnerPrestia

(57) ABSTRACT

The present invention provides a spun-bonded nonwoven fabric which is configured from polyolefin fibers that have excellent spinnability even if the single fiber diameter thereof is small, and which exhibits high flexibility and high uniformity. The present invention relates to a spun-bonded nonwoven fabric which is configured from fibers that are formed from a polyolefin resin and have a single fiber diameter of 6.5-14.5 μm, and which has a melt flow rate of 155-850 g/10 minutes and a CV value of the thickness of 13% or less.

6 Claims, No Drawings

SPUN-BONDED NONWOVEN FABRIC

CROSS-REFERENCE TO RELATED APPLICATIONS

This is the United States national phase of International Application No. PCT/JP2018/002238, filed Jan. 25, 2018, which claims priority to Japanese Application No. 2017/012871, filed Jan. 27, 2017. The disclosures of each of these applications are incorporated herein by reference in their entirety for all purposes.

FIELD OF THE INVENTION

The present invention relates to a spun-bonded nonwoven fabric which includes polyolefin fibers, is soft and highly uniform, and is suitable for use especially in hygienic material applications.

BACKGROUND OF THE RELATED ART

Nonwoven fabrics for use as hygienic materials in paper diapers, sanitary napkins, etc. are generally required to satisfy texture, touch, softness, and high production efficiency. Recently, however, highly uniform nonwoven fabrics with reduced thickness unevenness have come to be desired from the standpoint of processing stability in ultrasonic bonding, which is frequently used in steps for producing a paper diaper or sanitary napkin.

It is known that use of fibers with smaller diameter is effective in improving the softness and evenness. However, there have been problems in that such fibers are low in production efficiency and that in cases when drawing is conducted at a high spinning speed for increasing the production efficiency, filament breakage occurs, making stable production impossible.

Various proposals have hitherto been made on techniques for making the diameter of fibers smaller for use as nonwoven fabrics. For example, it has been proposed to employ an increased spinning speed to, for example, 5,000 m/min to thereby make the diameter of the fibers to be used smaller (see Patent Document 1). This proposal is surely effective in attaining an increase in production efficiently and an improvement in fiber strength because of the increased spinning speed. However, since a polypropylene-based resin having a relatively low melt flow rate is used as a raw material, the proposal has a problem in that filament breakage is prone to occur and stable production is impossible.

Meanwhile, a method has been proposed in which a polypropylene-based resin having a relatively high melt flow rate is used as a raw material and spun at a draft ratio of 1,500 or higher to attain a single-fiber fineness of 1.5 d or finer, thereby attaining both softness and strength (see Patent Document 2). However, the draft ratio defined in this proposal is given by an equation involving hole diameter and fiber diameter, and the proposal specifies a feature, in which a raw material having a high melt flow rate, i.e., low viscosity, is spun with a spinneret having a large hole diameter. Because of this, it is hard to apply spinneret pressure and even filament ejection is impossible, resulting in filament breakage and uneven fiber diameter. There has hence been a problem in that a uniform nonwoven fabric is difficult to obtain stably.

BACKGROUND ART DOCUMENTS

Patent Documents

Patent Document 1: JP-A-2013-159884
Patent Document 2: Japanese Patent No. 4943349

SUMMARY OF THE INVENTION

An object of the present invention, in view of the problems described above, is to provide a spun-bonded nonwoven fabric, which includes polyolefin fibers with excellent spinnability despite of their small single-fiber diameter and, which is soft and highly uniform and is especially suitable for use in hygienic material applications.

The spun-bonded nonwoven fabric of the present invention is a spun-bonded nonwoven fabric composed of fibers, the fibers include a polyolefin-based resin and have a single-fiber diameter of 6.5-14.5 μm and the spun-bonded nonwoven fabric has a melt flow rate of 155-850 g/10 min, and has a CV value of thickness of 13% or less.

According to a preferred embodiment of the spun-bonded nonwoven fabric of the present invention, at least one surface of the spun-bonded nonwoven fabric has a surface roughness SMD, as determined by a KES method, of 1.0-2.8 μm.

According to a preferred embodiment of the spun-bonded nonwoven fabric of the present invention, the spun-bonded nonwoven fabric has an average flexural rigidity B, as determined by the KES method, of 0.001-0.020 gf·cm$^2$/cm.

According to a preferred embodiment of the spun-bonded nonwoven fabric of the present invention, the polyolefin-based resin contains a fatty acid amide compound having 23-50 carbon atoms.

According to a preferred embodiment of the spun-bonded nonwoven fabric of the present invention, the fatty acid amide compound has been added in an amount of 0.01-5.0% by mass.

According to a preferred embodiment of the spun-bonded nonwoven fabric of the present invention, the fatty acid amide compound is ethylenebisstearic acid amide.

According to the present invention, a spun-bonded nonwoven fabric, which includes polyolefin fibers with excellent spinning stability and high production efficiency despite having a small single-fiber diameter and which is excellent in terms of softness and mechanical strength, is obtained. Furthermore, besides having these properties, the spun-bonded nonwoven fabric of the invention has excellent uniformity, with the CV value of thickness being 13% or less. Hence, this spun-bonded nonwoven fabric can have improved processing stability in ultrasonic bonding, which is frequently used especially in steps for producing hygienic materials.

DETAILED DESCRIPTION OF THE INVENTION

The spun-bonded nonwoven fabric of the present invention is composed of fibers that include a polyolefin-based resin and have a single-fiber diameter of 6.5-14.5 μm and the spun-bonded nonwoven fabric has a melt flow rate of 155-850 g/10 min, and has a CV value of thickness of 13% or less.

Examples of the polyolefin-based resin to be used in the present invention include polypropylene-based resins and polyethylene-based resins.

Examples of the polypropylene-based resins include propylene homopolymers and copolymers of propylene with various α-olefins. Examples of the polyethylene-based resins include ethylene homopolymers and copolymers of ethylene with various α-olefins. From the standpoints of spinnability and strength characteristics, it is especially preferred to use a polypropylene-based resin.

The polyolefin-based resin to be used in the present invention may be a mixture of two or more polyolefin-based resins. Use may also be made of a resin composition containing another olefin-based resin, a thermoplastic elastomer, etc.

Additives in common use, such as an antioxidant, weathering agent, light stabilizer, antistatic agent, antifogging agent, antiblocking agent, lubricant, nucleator, and pigment, or other polymers can be added to the polyolefin-based resin to be used in the present invention, so long as the addition thereof does not impair the effects of the invention.

The polyolefin-based resin to be used in the present invention has a melting point of preferably 80-200° C., more preferably 100-180° C. When the polyolefin-based resin has a melting point of preferably 80° C. or higher, more preferably 100° C. or higher, it is easy to obtain heat resistance which makes the fabric withstand practical use. When the polyolefin-based resin has a melting point of preferably 200° C. or lower, more preferably 180° C. or lower, it is easy to cool the filaments ejected from a spinneret, making it easy to conduct stable spinning while inhibiting the fibers from being fused to one another.

It is important that the melt flow rate (hereinafter often referred to as "MFR") of the spun-bonded nonwoven fabric of the present invention should be 155-850 g/10 min. By controlling the MFR thereof to 155-850 g/10 min, preferably 155-600 g/10 min, more preferably 155-400 g/10 min, the filaments being ejected can readily conform to deformations because of the low viscosity thereof, even when the filaments are drawn at a high spinning speed for increasing the production efficiency. Stable spinning is hence possible. In addition, the drawing at a high spinning speed can promote the orientation and crystallization of the fibers to impart high mechanical strength to the fibers.

The melt flow rate (MFR) of the spun-bonded nonwoven fabric is measured under the conditions of a load of 2,160 g and a temperature of 230° C. in accordance with ASTM D-1238.

The polyolefin-based resin to be used as a raw material for the spun-bonded nonwoven fabric has an MFR of 150-850 g/10 min, preferably 150-600 g/10 min, more preferably 150-400 g/10 min, for the same reasons as shown above. The MFR of this polyolefin-based resin also is measured under the conditions of a load of 2,160 g and a temperature of 230° C. in accordance with ASTM D-1238.

It is important that the polyolefin fibers which constitute the spun-bonded nonwoven fabric of the present invention should have a single-fiber diameter of 6.5-14.5 μm. By setting the single-fiber diameter thereof to 6.5-14.5 μm, preferably 7.5-13.5 μm, more preferably 8.4-11.8 μm, soft and highly uniform nonwoven fabrics can be obtained.

The spun-bonded nonwoven fabric of the present invention preferably has a tensile strength per unit basis weight of 1.8 N/5 cm/(g/m$^2$) or higher. By setting the tensile strength thereof per unit basis weight to 1.8 N/5 cm/(g/m$^2$) or higher, preferably 2.0 N/5 cm/(g/m$^2$) or higher, more preferably 2.2 N/5 cm/(g/m$^2$) or higher, the spun-bonded nonwoven fabric attains process passability in producing paper diapers, etc. and makes the products practically usable. With respect to upper limit, too high tensile strengths thereof may impair the softness. The tensile strength thereof hence is preferably 10.0 N/5 cm/(g/m$^2$) or less. The tensile strength can be controlled by changing the spinning speed, degree of press bonding with embossing rolls, temperature, linear pressure, etc.

The spun-bonded nonwoven fabric of the present invention has a CV value of thickness of 13% or less. By setting the CV value of thickness thereof to 13% or less, preferably 8% or less, more preferably 6% or less, the nonwoven fabric attains high uniformity and can be stably and uniformly bonded by ultrasonic bonding, which is frequently used in steps for producing paper diapers, etc. Meanwhile, when the nonwoven fabric has a CV value larger than 13%, that is, has highly uneven thickness, this nonwoven fabric may arouse a trouble that portions having a large thickness suffer insufficient bonding or portions having a small thickness are holed due to excessive bonding. The CV value can be controlled by changing the single-fiber diameter and the spinning speed.

The spun-bonded nonwoven fabric of the present invention has thicknesses preferably in the range of 0.05-1.5 mm. By setting the thickness range thereof to preferably 0.05-1.5 mm, more preferably 0.10-1.0 mm, even more preferably 0.10-0.8 mm, this spun-bonded nonwoven fabric attains softness and moderate cushioning properties and becomes especially suitable for paper diapers.

It is preferred that at least one surface of the spun-bonded nonwoven fabric of the present invention should have a surface roughness SMD, as determined by a KES method, of 1.0-2.8 μm. By setting the surface roughness SMD thereof as determined by the KES method to 1.0 μm or higher, preferably 1.3 μm or higher, more preferably 1.6 μm or higher, even more preferably 2.0 μm or higher, the spun-bonded nonwoven fabric can be prevented from being excessively densified to have an impaired texture or impaired softness.

Meanwhile, by setting the surface roughness SMD thereof as determined by the KES method to 2.8 μm or less, preferably 2.6 μm or less, more preferably 2.4 μm or less, even more preferably 2.3 μm or less, this spun-bonded nonwoven fabric can have surface smoothness with little rough feeling and have an excellent touch. The surface roughness SMD as determined by the KES method tends to become lower as the single-fiber diameter is smaller, and tends to become lower as the CV value of thickness is smaller. The surface roughness SMD can be controlled by suitably adjusting these.

The spun-bonded nonwoven fabric of the present invention preferably has an average flexural rigidity B, as determined by the KES method, of 0.001-0.020 gf·cm$^2$/cm. By setting the average flexural rigidity B thereof as determined by the KES method to preferably 0.020 cm$^2$/cm or less, more preferably 0.017 gf·cm$^2$/cm or less, even more preferably 0.015 cm$^2$/cm or less, this nonwoven fabric can have sufficient softness especially when used as a spun-bonded nonwoven fabric for hygienic materials. When the average flexural rigidity B thereof as determined by the KES method is extremely low, this nonwoven fabric may have poor handleability. It is hence preferable that the average flexural rigidity B thereof is 0.001 gf·cm$^2$/cm or higher. The average flexural rigidity B as determined by the KES method can be controlled by changing the basis weight, single-fiber diameter, and conditions for thermocompression bonding (degree of press bonding, temperature, and linear pressure).

In a preferred embodiment of the spun-bonded nonwoven fabric of the present invention, from the standpoint of improving the softness, the polyolefin fibers, which are constituent fibers, contain a fatty acid amide compound having 23-50 carbon atoms. It is known that a fatty acid amide compound incorporated into polyolefin fibers changes its rate of moving to the fiber surface depending on the number of carbon atoms thereof. By setting a fatty acid amide compound to have preferably 23 or more carbon atoms, more preferably 30 or more carbon atoms, this fatty acid amide compound is inhibited from excessively migrating to the fiber surface, and excellent spinnability and processing stability can be attained. High production efficiency can hence be maintained.

By setting a fatty acid amide compound to have preferably 50 or less carbon atoms, more preferably 42 or less carbon atoms, this fatty acid amide compound readily migrates to the fiber surface, making it possible to impart slipperiness and softness suitable for high-speed production of spun-bonded nonwoven fabrics.

Examples of the fatty acid amide compound having 23-50 carbon atoms to be used in the present invention include saturated fatty acid monoamide compounds, saturated fatty acid diamide compounds, unsaturated fatty acid monoamide compounds, and unsaturated fatty acid diamide compounds.

Specific examples of the fatty acid amide compound having 23-50 carbon atoms include tetradocosannoic acid amide, hexadocosanoic acid amide, octadocosanoic acid amide, nervonic acid amide, tetracosapentaenoic acid amide, nisi acid amide, ethylenebislauric acid amide, methylenebislauric acid amide, ethylenebisstearic acid amide, ethylenebishydroxystearic acid amide, ethylenebisbehenic acid amide, hexamethylenebisstearic acid amide, hexamethylenebisbehenic acid amide, hexamethylenehydroxystearic acid amide, distearyladipic acid amide, distearylsebacic acid amide, ethylenebisoleic acid amide, ethylenebiseruka acid amide, and hexamethylenebisoleic amide. Two or more of these amide compounds may be used in combination.

In the present invention, it is especially preferred to use ethylenebisstearic acid amide, which is a saturated fatty acid diamide compound, among those fatty acid amide compounds. Ethylenebisstearic acid amide has excellent thermal stability and is hence usable in melt spinning. With the polyolefin fibers into which ethylenebisstearic acid amide has been blended, a spun-bonded nonwoven fabric having excellent softness can be obtained while maintaining high production efficiency.

In a preferred embodiment of the invention, an addition amount of the fatty acid amide compound to the polyolefin fibers is 0.01-5.0% by mass. By setting the addition amount of the fatty acid amide compound to preferably 0.01-5.0% by mass, more preferably 0.1-3.0% by mass, even more preferably 0.1-1.0% by mass, moderate slipperiness and softness can be imparted while maintaining spinnability.

The term "addition amount" herein means the proportion by mass percent of the fatty acid amide compound added to the polyolefin fibers constituting the spun-bonded nonwoven fabric of the invention, specifically to the whole resin constituting the polyolefin fibers. For example, in the case where the fatty acid amide compound is added only to the sheath ingredient to be used as a component of core-sheath type composite fibers, the proportion thereof to the sum of the core and sheath ingredients is calculated.

In a preferred embodiment, the spun-bonded nonwoven fabric of the present invention has a bending resistance of 70 mm or less. By setting the bending resistance thereof to preferably 70 mm or less, more preferably 67 mm or less, even more preferably 64 mm or less, this spun-bonded nonwoven fabric can have sufficient softness especially when used as a nonwoven fabric for hygienic materials. With respect to lower limits of the bending resistance, the nonwoven fabric having a bending resistance which is too low may have poor handleability. The bending resistance thereof hence is preferably 10 mm or higher. The bending resistance can be controlled by changing the basis weight or the single-fiber diameter or by controlling the embossing rolls (degree of press bonding, temperature, and linear pressure).

The spun-bonded nonwoven fabric of the present invention preferably has a basis weight of 10-100 g/m$^2$. By setting a basis weight to preferably 10 g/m$^2$ or higher, more preferably 13 g/m$^2$ or higher, a spun-bonded nonwoven fabric having mechanical strength which renders the nonwoven fabric practically usable can be obtained. Meanwhile, in the case where a nonwoven fabric for use in hygienic material applications is desired, setting a basis weight to preferably 100 g/m$^2$ or less, more preferably 50 g/m$^2$ or less, even more preferably 30 g/m$^2$ or less enables to obtain a spun-bonded nonwoven fabric having moderate softness and suitable for use as hygienic materials.

Preferred modes for producing the spun-bonded nonwoven fabric of the present invention are explained below in detail.

A spun-bonding method, which is for producing a spun-bonded nonwoven fabric, is a production process including the steps of melting a resin, spinning the molten resin from a spinneret, subsequently cooling and solidifying the spun resin, drawing and stretching the resultant filaments with an ejector, collecting the filaments on a moving net to obtain a nonwoven fiber web, and then heat-bonding the fibers.

The spinneret and ejector to be used can have any of various shapes including round and rectangular shapes. In a preferred mode, a rectangular spinneret and a rectangular ejector are used in combination, from the standpoint that the amount of compressed air to be used is relatively small and the filaments are less apt to suffer fusion bonding to each other or abrasion therebetween.

In the present invention, the spinning temperature in melting and spinning a polyolefin-based resin is preferably 200-270° C., more preferably 210-260° C., even more preferably 220-250° C. By using a spinning temperature within that range, the polyolefin-based resin can be kept in a stable molten state, making it possible to obtain excellent spinning stability.

The polyolefin-based resin is melted in an extruder, metered to a spinneret, and ejected as long fibers. The hole diameter of spinneret is not particularly limited. However, since the polyolefin-based resin to be used in the present invention has a relatively high MFR, the hole diameter thereof is preferably 0.5 mm or less, more preferably 0.4 mm or less, even more preferably 0.3 mm or less. In case where thin fibers are spun with a spinneret having a large hole diameter, back pressure is less apt to be imposed in the spinneret and this not only causes ejection failures, resulting in fiber unevenness and fabric unevenness (thickness unevenness), but also causes filament breakage. Use of such spinnerets is hence undesirable. In a preferred mode, the relationship between hole diameter and fiber diameter which is represented by the following expression is less than 1,500.

$$(\text{hole diameter (mm)}^2)/(\text{fiber diameter (mm)}^2)<1{,}500$$

The ejected long-fiber filaments are then cooled. Examples of methods for cooling the ejected filaments include a method in which cold air is forcedly blown against the filaments, a method in which the filaments are allowed to cool naturally at the temperature of the atmosphere around the filaments, and a method in which the distance between the spinneret and the ejector is regulated. Two or more of these methods can be used in combination. Cooling conditions to be employed may be suitably adjusted while taking into account of the ejection rate per hole of the spinneret, spinning temperature, atmosphere temperature, etc.

Next, the filaments which have been cooled and solidified are drawn and stretched by the compressed air jetted from the ejector.

The spinning speed is preferably 3,500-6,500 m/min, more preferably 4,000-6,500 m/min, even more preferably 4,500-6,500 m/min. By controlling the spinning speed to 3,500-6,500 m/min, the process is made to have high production efficiency and the orientation and crystallization of the fibers are enhanced, making it possible to obtain long fibers having high strength. Because of this, the nonwoven fabric composed of such high-strength fibers also has excellent tenacity.

As stated above, the spinnability usually becomes worse as the spinning speed increases, making it impossible to stably produce filaments. In the present invention, however, the desired polyolefin fibers can be stably spun by using a polyolefin-based resin having an MFR within the specific range, use of which has not been found so far.

Subsequently, the long fibers obtained are collected on a moving net to form a nonwoven fiber web. In the present invention, due to stretching at high spinning speed, the fibers discharged from the ejector are collected, in the state of being controlled by a high-speed air stream on a net. The fibers are hence less apt to become entangled and a nonwoven fabric having high uniformity can be obtained.

The nonwoven fiber web obtained is subsequently united by heat bonding, and the desired spun-bonded nonwoven fabric can be obtained.

Examples of methods for uniting the nonwoven fiber web by heat bonding include methods of heat bonding with various rolls such as: hot embossing rolls which are a pair of rolls, upper and lower, that have an engraved surface (have recesses and protrusions on the surface) respectively; hot embossing rolls which include a combination of a roll having a flat (smooth) surface and a roll which has an engraved surface (has recesses and protrusions on the surface); and hot calendar rolls which include a pair of flat (smooth) rolls, upper and lower.

The heat bonding is conducted so as to result in a proportion of embossed bonding area of preferably 5-30%. By setting the proportion of embossed bonding area to preferably 5% or higher, more preferably 10% or higher, strength which renders the spun-bonded nonwoven fabric practically usable can be obtained. Meanwhile, by setting the proportion of embossed bonding area to preferably 30% or less, more preferably 20% or less, sufficient softness can be imparted to the spun-bonded nonwoven fabric especially for use as hygienic materials.

The term "proportion of embossed bonding area" herein has the following meanings. In the case of heat bonding with a pair of rolls having recesses and protrusions, that term means the proportion of those portions of the nonwoven fiber web with which both protrusions of the upper roll and protrusions of the lower roll have come into contact to the whole nonwoven fabric. In the case of heat bonding with a roll having recesses and protrusions and a flat roll, that term means the proportion of those portions of the nonwoven fiber web with which protrusions of the roll having recesses and protrusions have come into contact to the whole nonwoven fabric.

The shape of the protrusions formed by engraving in the hot embossing rolls can be any of circular, elliptic, square, rectangular, parallelogrammic, rhombic, regularly hexagonal, and regularly octagonal shapes and the like.

In a preferred made, the hot rolls have a surface temperature which is lower by 50° C. to 15° C. than the melting point of the polyolefin-based resin being used. By setting the surface temperature of the hot rolls to a temperature lower than the melting point of the polyolefin-based resin preferably by 50° C. or less, more preferably by 45° C. or less, the fibers can be moderately heat-bonded to enable the web to retain the form of nonwoven fabric. By setting the surface temperature of the hot rolls to a temperature lower than the melting point of the polyolefin-based resin preferably by 15° C. or larger, more preferably by 20° C. or larger, excessive heat bonding can be inhibited and sufficient softness can be imparted to the spun-bonded nonwoven fabric especially for use as hygienic materials.

The linear pressure of the hot embossing rolls during the heat bonding is preferably 50-500 N/cm. By setting the linear pressure of the rolls to preferably 50 N/cm or higher, more preferably 100 N/cm or higher, even more preferably 150 N/cm or higher, the fibers can be sufficiently heat-bonded to obtain strength which renders the nonwoven fabric practically usable. Meanwhile, by setting the linear pressure of the rolls to preferably 500 N/cm or less, more preferably 400 N/cm or less, even more preferably 300 N/cm or less, sufficient softness can be imparted to the nonwoven fabric especially for use as hygienic materials.

Since the spun-bonded nonwoven fabric of the present invention is soft and has extremely high uniformity, this nonwoven fabric is suitable for use in hygienic material applications including disposable paper diapers and napkins. The nonwoven fabric is especially suitable for use as the back sheets of paper diapers, among hygienic materials.

EXAMPLES

The present invention is explained below in detail by reference to Examples. However, the invention should not be construed as being limited to the Examples only.

(1) Melt Flow Rate (MFR) (g/10 Min) of Polyolefin-Based Resin:

The melt flow rate of a polyolefin-based resin was measured in accordance with ASTM D-1238 under the conditions of a load of 2,160 g and a temperature of 230° C.

(2) Single-Fiber Diameter (μm):

Ten small sample pieces were randomly collected from a nonwoven web obtained by drawing and stretching spun filaments with an ejector and then collecting the filaments on a net. The surface of each sample was photographed with a microscope at a magnification of 500-1,000 diameters. Ten fibers were selected from each sample, and the hundred fibers in total were examined for width. Average value thereof was calculated, and was taken as the single-fiber diameter (μm).

(3) Spinning Speed (m/Min):

The mass per the length of 10,000 m was calculated from the single-fiber diameter and the solid density of the resin used, and the calculated value was rounded off to the nearest tenth to obtain the single-fiber fineness. The spinning speed was calculated from the single-fiber fineness (dtex) and the rate of resin ejection from each hole of the spinneret (hereinafter referred to as "single-hole ejection rate") (g/min) set in each example, using the following equation.

$$\text{Spinning speed}=[10{,}000\times(\text{single-hole ejection rate})]/(\text{single-fiber fineness})$$

(4) Basis Weight (g/m$^2$):

In accordance with JIS L1913 (year 2010), 6.2 "Mass per unit area", three test pieces having a size of 20 cm×25 cm were cut out per the sample width of 1 m and were each examined for normal-state mass (g). An average of the measured values was converted to mass per m$^2$ (g/m$^2$).

(5) CV Value of Thickness (%):

Using a compressive modulus tester (Type SE-15, manufactured by INTEC Co., Ltd.), ten portions lying at equal intervals along the CD direction were examined under the conditions of a pressure foot size of 2 cm$^2$ and a load of 7 cN. This measurement was repeatedly conducted three times in total in different positions along the MD direction. Thirty portions in total were thus examined to obtain a standard deviation (mm) and an average value (mm), from which the CV value was calculated using the following equation.

$$\text{CV value of thickness}=[\text{standard deviation (mm)}]/[\text{average value (mm)}]\times 100$$

(6) Surface Roughness SMD (μm) of Spun-Bonded Nonwoven Fabric by KES Method:

A spun-bonded nonwoven fabric was examined for surface roughness SMD by a normal-state test according to a KES method. First, three test pieces having a size of 200 mm (width)×200 mm were cut out from portions of the spun-bonded nonwoven fabric which lay at equal intervals along the transverse direction of the fabric. The test pieces were examined with automatic surface tester KES-FB4-AUTO-A, manufactured by Kato Tech Co., Ltd. Each test piece was set on the sample table and the surface of the test piece was scanned with a contact element for surface roughness examination on which a load of 10 gf was being imposed (material; piano wire having a diameter of 0.5 mm: contact length; 5 mm) to determine an average deviation of surface irregularities. This measurement was made in the lengthwise direction (longitudinal direction of the nonwoven fabric) and widthwise direction (transverse direction of the nonwoven fabric) of each of all the test pieces. The resultant six average deviations were averaged, and the average was rounded off to the nearest tenth to obtain the surface roughness SMD (μm). The two surfaces of the spun-bonded nonwoven fabric were thus examined for surface roughness SMD, and the smaller of the two values is given in Table 1.

(7) Flexural Rigidity B (gf·cm$^2$/cm) of Spun-Bonded Nonwoven Fabric by KES Method:

A spun-bonded nonwoven fabric was examined for flexural rigidity B by a normal-state test according to the KES method. First, three test pieces having a size of 200 mm (width)×200 mm were cut out along the lengthwise direction (longitudinal direction of the nonwoven fabric) and also along the widthwise direction (transverse direction of the nonwoven fabric). The test pieces were examined with flexural property tester KES-FB2, manufactured by Kato Tech Co., Ltd. Each sample was attached to chucks 1 cm apart from each ether, and a pure bending test was conducted in the range of curvature of −2.5 to +2.5 cm$^{-1}$ at a deformation rate of 0.50 cm$^{-1}$. The measured values were averaged and rounded off to the nearest thousandth to thereby determine the flexural rigidity B.

(8) Bending Resistance (mm):

In accordance with BS L1913 (year-2010 edition), item 6.7.3, five test pieces having a size of 25 mm (width)×150 mm are cut out. Each test piece is placed on a horizontal table having a slope of 45°, so that one of the short sides of the test piece lies on the base line of a scale. The test piece is manually slid toward the slope and, at the time when the center of the leading end of the test piece has come into contact with the slope, the distance over which the other end has moved is read with the scale. The front and back surfaces of each of the five test pieces were thus examined, and an average value was calculated.

(9) Tensile Strength Per Unit Basis Weight (N/5 cm)/(g/m$^2$):

In accordance with JIS L1913 (year 2010), 6.3.1, three samples cut out along the machine direction and three samples cut out along the cross direction were each subjected to a tensile test under the conditions of a sample size of 5 cm×30 cm, a chuck-to-chuck distance of 20 cm, and a stretching speed of 10 cm/min. The strength at the time when the sample broke was taken as the tensile strength (N/5 cm). The measured values were averaged and rounded off to the nearest tenth. Subsequently, the tensile strength per unit basis weight was calculated from the calculated tensile strength (N/5 cm) and the basis weight (g/m$^2$) obtained in (3) above, using the following equation, the calculated value being rounded off to the nearest tenth.

$$\text{Tensile strength per unit basis weight}=[\text{tensile strength (}N\text{/5 cm)}]/[\text{basis weight (g/m}^2\text{)}]$$

(10) Melt Flow Rate (MFR) (g/10 min) of Spun-Bonded Nonwoven Fabric:

A measurement was made in accordance with JIS K7210 (year-1999 edition) at a load of 2,160 g and a temperature of 230° C.

Example 1

A polypropylene resin having a melt flow rate (MFR) of 170 g/10 min was melted with an extruder and ejected from a rectangular spinneret having a hole diameter of 0.30 mm at a spinning temperature of 235° C. and at a single-hole ejection rate of 0.32 g/min. The resultant filaments were cooled and solidified, subsequently drawn and stretched by compressed air jetted from a rectangular ejector at an ejector pressure of 0.35 MPa, and then collected on a moving net, thereby obtaining a nonwoven fiber web composed of long polypropylene fibers. The long polypropylene fibers obtained had the following properties. The single-fiber diameter was 9.8 μm, and the spinning speed calculated therefrom was 4,632 m/min. With respect to spinnability, no filament breakage occurred during 1-hour spinning, and the resin showed satisfactory spinnability.

Subsequently, a pair of embossing rolls composed of an upper roll, which was a metallic embossing roll having polka dots formed by engraving and having a proportion of bonding area of 16%, and a lower roll, which was a metallic flat roll, was used to heat-bond the obtained nonwoven fiber web at a linear pressure of 30 N/cm and a heat-bonding temperature of 130° C. Thus, a spun-bonded nonwoven fabric having a basis weight of 18 g/m$^2$ was obtained. The spun-bonded nonwoven fabric obtained was evaluated. The results thereof are shown in Table 1.

Example 2

A spun-bonded nonwoven fabric composed of long polypropylene fibers was obtained by the same method as in Example 1, except that the MFR of the polypropylene resin was changed to 300 g/10 min. The long polypropylene fibers obtained had the following properties. The single-fiber diameter was 9.2 and the spinning speed calculated therefrom was 5,342 m/min. With respect to spinnability, no filament breakage occurred during 1-hour spinning, and the resin showed satisfactory spinnability. The spun-bonded nonwoven fabric obtained was evaluated. The results thereof are shown in Table 1.

Example 3

A spun-bonded nonwoven fabric was obtained by the same method as in Example 1, except that the MFR of the polypropylene resin was changed to 800 g/10 min. The long polypropylene fibers obtained had the following properties. The single-fiber diameter was 8.4 μm, and the spinning speed calculated therefrom was 6,422 m/min. With respect to spinnability, no filament breakage occurred during 1-hour spinning, and the resin showed satisfactory spinnability. The spun-bonded nonwoven fabric obtained was evaluated. The results thereof are shown in Table 1.

Example 4

A spun-bonded nonwoven fabric was obtained by the same method as in Example 1, except that the single-hole ejection rate was changed to 0.75 g/min. The long polypropylene fibers obtained had the following properties. The single-fiber diameter was 14.4 μm, and the spinning speed calculated therefrom was 5,064 m/min. With respect to spinnability, no filament breakage occurred during 1-hour spinning, and the resin showed satisfactory spinnability. The spun-bonded nonwoven fabric obtained was evaluated. The results thereof are shown in Table 1.

Example 5

A spun-bonded nonwoven fabric was obtained by the same method as in Example 1, except that the single-hole ejection rate was changed to 0.56 g/min. The long polypropylene fibers obtained had the following properties. The single-fiber diameter was 12.4 μm, and the spinning speed calculated therefrom was 5,111 m/min. With respect to spinnability, no filament breakage occurred during 1-hour spinning, and the resin showed satisfactory spinnability. The spun-bonded nonwoven fabric obtained was evaluated. The results thereof are shown in Table 1.

Example 6

A spun-bonded nonwoven fabric was obtained by the same method as in Example 1, except that 1.0% by mass ethylenebisstearic acid amide was added as a fatty acid amide compound to the polypropylene resin. The long polypropylene fibers obtained had the following properties. The single-fiber diameter was 9.9 μm, and the spinning speed calculated therefrom was 4,611 m/min. With respect to spinnability, no filament breakage occurred during 1-hour spinning, and the resin showed satisfactory spinnability. The spun-bonded nonwoven fabric obtained was evaluated. The results thereof are shown in Table 1.

Comparative Example 1

Production of a spun-bonded nonwoven fabric was attempted by the same method as in Example 1, except that the MFR of the polypropylene resin was changed to 35 g/10 min. However, filament breakage began to occur frequently from just after initiation of the spinning. The production was hence terminated.

Comparative Example 2

A spun-bonded nonwoven fabric was obtained by the same method as in Example 1, except that the MFR of the polypropylene resin was changed to 60 g/10 min and the ejector pressure was changed to 0.25 MPa. The long polypropylene fibers obtained had the following properties. The single-fiber diameter was 10.4 and the spinning speed calculated therefrom was 4,120 m/min. With respect to spinnability, filament breakage occurred ten times during 1-hour spinning, and the resin showed poor spinnability. The spun-bonded nonwoven fabric obtained was evaluated. The results thereof are shown in Table 1.

Comparative Example 3

A spun-bonded nonwoven fabric was obtained by the same method as in Example 1, except that the MFR of the polypropylene resin was changed to 35 g/10 min, the single-hole ejection rate was changed to 0.56 g/min, and the ejector pressure was changed to 0.20 MPa. The long polypropylene fibers obtained had the following properties. The single-fiber diameter was 16.1 μm, and the spinning speed calculated therefrom was 3,043 m/min. With respect to spinnability, no filament breakage occurred during 1-hour spinning, and the resin showed satisfactory spinnability. The spun-bonded nonwoven fabric obtained was evaluated. The results thereof are shown in Table 1.

Comparative Example 4

A spun-bonded nonwoven fabric was obtained by the same method as in Example 1, except that the MFR of the polypropylene resin was changed to 35 g/10 min, the single-hole ejection rate was changed to 0.21 g/min, and the ejector pressure was changed to 0.20 MPa. The long polypropylene fibers obtained had the following properties. The single-fiber diameter was 9.9 μm, and the spinning speed calculated therefrom was 3,021 m/min. With respect to spinnability, no filament breakage occurred during 1-hour spinning, and the resin showed satisfactory spinnability. The spun-bonded nonwoven fabric obtained was evaluated. The results thereof are shown in Table 1.

TABLE 1

| | | Unit | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|---|
| Resin | Kind of resin | — | PP | PP | PP | PP | PP | PP | PP | PP | PP | PP |
| | MFR | g/10 min | 170 | 300 | 800 | 170 | 170 | 170 | 35 | 60 | 35 | 35 |
| | Fatty acid amide | — | — | — | — | — | — | ethylenebis- | — | — | — | — |

TABLE 1-continued

| | Unit | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|---|
| | | | | | | | stearic acid amide | | | | |
| Hole diameter of spinneret | mm | 0.3 | 0.3 | 0.3 | 0.3 | 0.3 | 0.3 | 0.3 | 0.3 | 0.3 | 0.3 |
| Spinning temperature | ° C. | 235 | 235 | 235 | 235 | 235 | 235 | 235 | 235 | 235 | 235 |
| Single-hole ejection rate | g/min | 0.32 | 0.32 | 0.32 | 0.75 | 0.56 | 0.32 | 0.32 | 0.32 | 0.56 | 0.21 |
| Heat-bonding temperature | ° C. | 130 | 130 | 130 | 130 | 130 | 130 | 130 | 130 | 130 | 130 |
| Ejector pressure | MPa | 0.35 | 0.35 | 0.35 | 0.35 | 0.35 | 0.35 | 0.35 | 0.25 | 0.20 | 0.20 |
| Single-fiber diameter | μm | 9.8 | 9.2 | 8.4 | 14.4 | 12.4 | 9.9 | — | 10.4 | 16.1 | 9.9 |
| Spinning speed | m/min | 4632 | 5342 | 6422 | 5064 | 5111 | 4611 | — | 4120 | 3043 | 3021 |
| Number of times of filament breakage | times/hr | 0 | 0 | 0 | 0 | 0 | 0 | frequent | 10 | 0 | 0 |
| MFR | g/10 min | 183 | 331 | 836 | 191 | 190 | 190 | 41 | 71 | 45 | 43 |
| Basis weight | $g/m^2$ | 18 | 18 | 18 | 18 | 18 | 18 | 18 | 18 | 18 | |
| Tensile strength per unit basis weight | (N/5 cm)/($g/m^2$) | 2.4 | 2.5 | 2.5 | 2.5 | 2.4 | 2.4 | — | 2.1 | 2.0 | 2.0 |
| CV value of thickness | % | 6 | 6 | 5 | 11 | 9 | 6 | — | 7 | 16 | 11 |
| Surface roughness | μm | 2.3 | 2.2 | 2.1 | 2.6 | 2.4 | 2.3 | — | 2.4 | 3.0 | 2.9 |
| Flexural rigidity | gf · $cm^2$/cm | 0.011 | 0.011 | 0.010 | 0.014 | 0.013 | 0.009 | — | 0.011 | 0.023 | 0.011 |
| Bending resistance | mm | 64 | 64 | 63 | 68 | 68 | 59 | — | 65 | 70 | 66 |

In Examples 1 to 6, the resins showed satisfactory spinnability even at high spinning speeds. The Examples hence gave results in which the production process had high production efficiency and high stability. In Examples 1 to 6, since thickness reduction was attained by high spinning speeds, the spun-bonded nonwoven fabrics had a small CV value of thickness and were excellent in terms of uniformity and mechanical strength. With respect to softness, Example 6, in which ethylenebisstearic acid amide had been added, showed especially excellent softness.

Meanwhile, as Comparative Examples 1 and 2 show, in cases when polypropylene resins having a relatively low MFR were used, there was a problem in that filament breakage occurred at a high spinning speed and stable production was impossible. As Comparative Example 3 shows, the large single-fiber diameter resulted in poor uniformity. Comparative Example 4, in which the small fiber diameter was obtained with a reduced ejection rate and a low spinning speed, gave results in which the production efficiency was low although the resin showed satisfactory spinnability and in which the fibers became entangled with each other before reaching the net, because of the low spinning speed, resulting in poor uniformity.

While the invention has been described in detail and with reference to specific embodiments thereof, it will be apparent to one skilled in the art that various changes and modifications can be made therein without departing from the spirit and scope thereof. This application is based on a Japanese patent application filed on Jan. 27, 2017 (Application No. 2017-012871), the entire contents thereof being incorporated herein by reference.

The invention claimed is:

1. A spun-bonded nonwoven fabric comprised of fibers, wherein the fibers comprise a polyolefin-based resin and have a single-fiber diameter of 6.5-12.4 μm, the spun-bonded nonwoven fabric has a melt flow rate of 155-850 g/10 min, and has a CV value of thickness of 9% or less, and at least one surface of the spun-bonded nonwoven fabric has a surface roughness SMD, as determined by a KES method, of 1.0-2.8 μm.

2. The spun-bonded nonwoven fabric according to claim 1, wherein at least one surface thereof has a surface roughness SMD, as determined by a KES method, of 1.0-2.6 μm.

3. The spun-bonded nonwoven fabric according to claim 1, having an average flexural rigidity B, as determined by a KES method, of 0.001-0.020 gf·$cm^2$/cm.

4. The spun-bonded nonwoven fabric according to claim 1, wherein the polyolefin-based resin comprises a fatty acid amide compound having 23-50 carbon atoms.

5. The spun-bonded nonwoven fabric according to claim 4, wherein an addition amount of the fatty acid amide compound is 0.01-5.0% by mass.

6. The spun-bonded nonwoven fabric according to claim 4, wherein the fatty acid amide compound is ethylenebisstearic acid amide.

* * * * *